US008513871B2

(12) United States Patent
You et al.

(10) Patent No.: US 8,513,871 B2
(45) Date of Patent: Aug. 20, 2013

(54) APPARATUS AND METHODS FOR COMBINING LIGHT EMITTERS

(71) Applicant: Cree, Inc., Durham, NC (US)

(72) Inventors: Chenhua You, Cary, NC (US); John K. Roberts, Grand Rapids, MI (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/714,955

(22) Filed: Dec. 14, 2012

(65) Prior Publication Data

US 2013/0107515 A1 May 2, 2013

Related U.S. Application Data

(62) Division of application No. 12/057,748, filed on Mar. 28, 2008, now Pat. No. 8,350,461.

(51) Int. Cl.
*H01J 1/62* (2006.01)
*H05B 37/00* (2006.01)

(52) U.S. Cl.
USPC ..... 313/498; 313/501; 362/230; 362/234

(58) Field of Classification Search
USPC ..... 315/312, 291, 294; 362/253, 230, 362/231, 234, 235, 237, 236; 313/498, 503, 313/501, 502
See application file for complete search history.

(56) References Cited

U.S. PATENT DOCUMENTS 4,120,026 A 10/1978 Tsuchihashi et al.
4,710,699 A 12/1987 Miyamoto
5,477,436 A 12/1995 Bertling et al.
5,803,579 A 9/1998 Turnbull et al.
5,851,063 A 12/1998 Doughty et al.
6,132,072 A 10/2000 Turnbull et al.
6,212,213 B1 4/2001 Weber et al.
6,234,648 B1 5/2001 Borner et al.
6,252,254 B1 6/2001 Soules et al.
6,319,425 B1 11/2001 Tasaki et al.
6,337,536 B1 1/2002 Matsubara et al.

(Continued)

FOREIGN PATENT DOCUMENTS

DE 39 16 875 A1 12/1990
DE 42 28 895 A1 3/1994

(Continued)

OTHER PUBLICATIONS

International Search Report and Written Opinion (15 pages) corresponding to International Application No. PCT/US2009/001843; Mailing Date: Jul. 15, 2009.

(Continued)

*Primary Examiner* — David H Vu
(74) *Attorney, Agent, or Firm* — Myers Bigel Sibley & Sajovec

(57) ABSTRACT

Provided are methods and apparatus for combining light emitters and devices including the same. Embodiments include methods of selecting combinations of multiple light emitters that are grouped into multiple bins. The multiple bins correspond to multiple emitter group regions in a multiple axis color space and multiple luminosity ranges. Such methods may include prioritizing multiple combinations of light emitters from at least two of the bins, each of the combinations including chromaticity values corresponding to a desired color region and a luminosity value corresponding to a specified luminosity range.

18 Claims, 11 Drawing Sheets

(56) References Cited

U.S. PATENT DOCUMENTS 6,373,188 B1 4/2002 Johnson et al.
6,429,583 B1 8/2002 Levinson et al.
6,441,558 B1 8/2002 Muthu et al.
6,480,299 B1 11/2002 Drakopoulos et al.
6,508,564 B1 * 1/2003 Kuwabara et al. ..... 362/612
6,513,949 B1 2/2003 Marshall et al.
6,522,065 B1 2/2003 Srivastava et al.
6,538,371 B1 3/2003 Duggal et al.
6,547,249 B2 4/2003 Collins, III et al.
6,550,949 B1 4/2003 Bauer et al.
6,552,495 B1 4/2003 Chang
6,577,073 B2 6/2003 Shimizu et al.
6,600,175 B1 7/2003 Baretz et al.
6,600,324 B2 7/2003 St. Germain
6,616,862 B2 9/2003 Srivastava et al.
6,624,638 B2 9/2003 St. Germain
6,635,503 B2 10/2003 Andrews et al.
6,636,003 B2 10/2003 Rahm et al.
6,642,666 B1 11/2003 St. Germain
6,685,852 B2 2/2004 Setlur et al.
6,692,136 B2 2/2004 Marshall et al.
6,703,173 B2 3/2004 Lu et al.
6,737,801 B2 5/2004 Ragle
6,744,194 B2 6/2004 Fukasawa et al.
6,762,563 B2 7/2004 St. Germain et al.
6,784,463 B2 8/2004 Camras et al.
6,817,735 B2 11/2004 Shimizu et al.
6,841,804 B1 1/2005 Chen et al.
6,882,101 B2 4/2005 Ragle
6,885,035 B2 4/2005 Bhat et al.
6,914,267 B2 7/2005 Fukasawa et al.
6,936,857 B2 8/2005 Doxsee et al.
6,957,899 B2 10/2005 Jiang et al.
6,967,116 B2 11/2005 Negley
7,005,679 B2 2/2006 Tarsa et al.
7,008,078 B2 3/2006 Shimizu et al.
7,009,199 B2 3/2006 Hall
7,009,343 B2 3/2006 Lim et al.
7,014,336 B1 3/2006 Ducharme et al.
7,023,019 B2 4/2006 Maeda et al.
7,066,623 B2 6/2006 Lee et al.
7,095,056 B2 8/2006 Vitta et al.
7,125,143 B2 10/2006 Hacker
7,135,664 B2 11/2006 Vornsand et al.
7,141,442 B2 11/2006 Sano
7,207,691 B2 4/2007 Lee et al.
7,213,940 B1 5/2007 Van De Ven et al.
7,213,942 B2 5/2007 Jiang et al.
7,221,044 B2 5/2007 Fan et al.
7,250,715 B2 7/2007 Mueller et al.
7,256,557 B2 8/2007 Lim et al.
7,262,439 B2 8/2007 Radkov
7,278,760 B2 10/2007 Heuser et al.
7,358,954 B2 4/2008 Negley et al.
7,365,485 B2 4/2008 Fukasawa et al.
7,387,405 B2 6/2008 Dutcharme et al.
7,417,259 B2 8/2008 Sakai et al.
7,422,504 B2 9/2008 Maeda et al.
7,453,195 B2 11/2008 Radkov
7,473,934 B2 1/2009 Nagai et al.
7,564,180 B2 7/2009 Brandes
7,731,389 B2 * 6/2010 Draganov et al. ..... 362/231
2003/0030063 A1 2/2003 Sosniak et al.
2003/0042908 A1 3/2003 St. Germain
2003/0089918 A1 5/2003 Hiller et al.
2004/0046178 A1 3/2004 Sano
2004/0105264 A1 6/2004 Spero
2004/0264193 A1 12/2004 Okumura
2005/0030744 A1 2/2005 Ducharme et al.
2005/0157515 A1 7/2005 Chen et al.
2006/0012989 A1 1/2006 Lee
2006/0022582 A1 2/2006 Radkov
2006/0049332 A1 3/2006 Vornsand et al.
2006/0060872 A1 3/2006 Edmond
2006/0105482 A1 5/2006 Alferink et al.
2006/0113548 A1 6/2006 Chen et al.
2006/0138435 A1 6/2006 Tarsa et al.
2006/0138937 A1 6/2006 Ibbetson
2006/0181192 A1 8/2006 Radkov et al.
2006/0245184 A1 11/2006 Galli
2007/0001188 A1 1/2007 Lee
2007/0034775 A1 2/2007 Cheng et al.
2007/0051966 A1 3/2007 Hagashi et al.
2007/0081357 A1 4/2007 Kim et al.
2007/0090381 A1 4/2007 Otsuka et al.
2007/0137074 A1 6/2007 Van De Ven
2007/0139920 A1 6/2007 Van De Ven et al.
2007/0139923 A1 6/2007 Negley et al.
2007/0170447 A1 7/2007 Negley et al.
2007/0171145 A1 7/2007 Coleman et al.
2007/0202623 A1 8/2007 Gao et al.
2007/0211463 A1 9/2007 Chevalier et al.
2007/0216704 A1 9/2007 Roberts et al.
2007/0223219 A1 9/2007 Medendorp, Jr. et al.
2007/0236911 A1 10/2007 Negley
2007/0263393 A1 11/2007 Van De Ven
2007/0267983 A1 11/2007 Van De Ven et al.
2007/0274063 A1 11/2007 Negley
2007/0274080 A1 11/2007 Negley et al.
2007/0276606 A1 11/2007 Radkov et al.
2007/0278503 A1 12/2007 Van De Ven et al.
2007/0278934 A1 12/2007 Van De Ven et al.
2007/0278974 A1 12/2007 Van De Ven
2007/0279440 A1 12/2007 Negley
2007/0279903 A1 12/2007 Negley et al.
2007/0280624 A1 12/2007 Negley et al.
2008/0084685 A1 4/2008 Van De Ven et al.
2008/0084700 A1 4/2008 Van De Ven
2008/0084701 A1 4/2008 Van De Ven et al.
2008/0088248 A1 4/2008 Myers
2008/0089053 A1 4/2008 Negley
2008/0106895 A1 5/2008 Van de Ven et al.
2008/0106907 A1 5/2008 Trott et al.
2008/0112168 A1 5/2008 Pickard
2008/0112170 A1 5/2008 Trott et al.
2008/0112183 A1 5/2008 Negley
2008/0130265 A1 6/2008 Negley et al.
2008/0130285 A1 6/2008 Negley et al.
2008/0130298 A1 6/2008 Negley et al.
2008/0136313 A1 6/2008 Van De Ven et al.
2008/0137347 A1 6/2008 Trott et al.
2008/0179602 A1 7/2008 Negley et al.
2008/0211416 A1 9/2008 Negley et al.
2008/0231201 A1 9/2008 Higley et al.
2008/0259589 A1 10/2008 Van De Ven
2008/0278928 A1 11/2008 Van De Ven et al.
2008/0278940 A1 11/2008 Van De Ven et al.
2008/0278950 A1 11/2008 Pickard et al.
2008/0278952 A1 11/2008 Trott et al.
2008/0304260 A1 12/2008 Van De Ven et al.
2008/0304261 A1 12/2008 Van De Ven et al.
2008/0304269 A1 12/2008 Pickard et al.
2008/0309255 A1 12/2008 Myers et al.
2008/0310154 A1 12/2008 Van De Ven et al.
2009/0108269 A1 4/2009 Negley et al.
2009/0160363 A1 6/2009 Negley et al.
2009/0161356 A1 6/2009 Negley et al.
2009/0184616 A1 7/2009 Van De Ven et al.
2009/0184666 A1 7/2009 Myers et al.
2009/0246895 A1 10/2009 You et al.
2011/0037413 A1 2/2011 Negley et al. ..... 315/294

FOREIGN PATENT DOCUMENTS

DE 103 35 077 A1 3/2005
EP 0 838 866 A2 4/1998
EP 0 971 421 A2 1/2000
EP 1 024 399 A1 8/2000
EP 1 160 883 A2 12/2001
EP 1 193 772 A2 4/2002
EP 1 367 655 A1 12/2003
EP 1 462 711 A1 9/2004
EP 1 571 715 A1 6/2005
EP 1 566 848 A2 8/2005
EP 1 760 795 A2 3/2007

| | | | |
|---|---|---|---|
| JP | 10-163535 | | 6/1998 |
| JP | 2000-183408 | | 6/2000 |
| JP | 2001 156331 | | 6/2001 |
| JP | 2001/307506 | | 11/2001 |
| JP | 2002-150821 | | 5/2002 |
| JP | 2003-515956 | | 5/2003 |
| JP | 2003-529889 | | 10/2003 |
| JP | 2004-080046 | | 3/2004 |
| JP | 2004-103443 | | 4/2004 |
| JP | 2004-253309 | | 9/2004 |
| JP | 2004-356116 | | 12/2004 |
| JP | 2004-363055 | | 12/2004 |
| JP | 2005-142311 | | 6/2005 |
| JP | 2006-229055 | A | 8/2006 |
| JP | 2007-080530 | A | 3/2007 |
| JP | 2007-109616 | A | 4/2007 |
| JP | 2007-122950 | | 5/2007 |
| JP | 2007-128822 | A | 5/2007 |
| JP | 2007-141737 | | 6/2007 |
| WO | WO 00/19546 | A1 | 4/2000 |
| WO | WO 01/24584 | A1 | 4/2001 |
| WO | WO 2005/004202 | A2 | 1/2005 |
| WO | WO 2005/013365 | A2 | 2/2005 |
| WO | WO 2005/124877 | A2 | 12/2005 |
| WO | WO 2006/028312 | A1 | 3/2006 |
| WO | WO 2006/061728 | A2 | 6/2006 |
| WO | WO 2008/139174 | A1 | 11/2008 |

OTHER PUBLICATIONS

U.S. Appl. No. 60/978,880, filed Oct. 10, 2007, Van De Ven.
U.S. Appl. No. 60/990,435, filed Nov. 27, 2007, Van De Ven.
U.S. Appl. No. 60/990,439, filed Nov. 27, 2007, Negley.
U.S. Appl. No. 60/990,724, filed Nov. 28, 2007, Negley.
U.S. Appl. No. 61/022,886, filed Jan. 23, 2008, Myers.
U.S. Appl. No. 61/037,365, filed Mar. 18, 2008, Van De Ven.
U.S. Appl. No. 61/039,926, filed Mar. 27, 2008, Myers.
U.S. Appl. No. 61/041,404, filed Apr. 1, 2008, Negley.
U.S. Appl. No. 61/075,513, filed Jun. 25, 2008, Roberts.
Compound Semiconductors Online, "LED Lighting Fixtures, Inc. Sets World Record at 80 Lumens per Watt for Warm White".
Cree® XLamp® 7090 XR-E Series LED Binning and Labeling.
CSA international, "Test Data Report", Project No. 1786317, Report No. 1786317-1 (Apr. 2006).
DOE SSL CALiper Report , "Product Test Reference: CALiPER 07-47 Downlight Lamp".
DOE SSL CALiPer Report, "Product Test Reference: CALiPER 07-31 Downlight Lamp".
International Search Report and Written Opinion corresponding to International Application No. PCT/US2007/009462; Mailing Date: Oct. 24, 2008.
International Search Report and Written Opinion corresponding to International Application No. PCT/US2007/009459; Mailing Date: Mar. 3, 2008.
International Search Report and Written Opinion corresponding to International Application No. PCT/US2008/054665; Mailing Date: Jul. 16, 2008.
International Search Report and Written Opinion corresponding to International Application No. PCT/US2007/086593; Mailing Date: Apr. 18, 2008.
International Search Report and Written Opinion corresponding to International Application No. PCT/US2006/048654; Mailing Date: Feb. 13, 2008.
International Search Report and Written Opinion corresponding to International Application No. PCT/US2008/063042; Mailing Date: Jul. 21, 2008.
International Search Report and Written Opinion corresponding to International Application No. PCT/US2007/086027; Mailing Date: Apr. 25, 2008.
International Search Report and Written Opinion corresponding to International Application No. PCT/US2008/063021; Mailing Date: Aug. 5, 2008.
International Search Report and Written Opinion corresponding to International Application No. PCT/US2008/051633; Mailing Date: Aug. 14, 2008.
International Search Report and Written Opinion corresponding to International Application No. PCT/US2008/063016; Mailing Date: Aug. 5, 2008.
International Search Report and Written Opinion corresponding to International Application No. PCT/US2008/063027; Mailing Date: Jul. 23, 2008.
International Search Report and Written Opinion corresponding to International Application No. PCT/US2007/09629; Mailing Date: Feb. 11, 2008.
International Search Report and Written Opinion corresponding to International Application No. PCT/US2008/079299; Mailing Date: Jan. 9, 2009.
International Search Report and Written Opinion corresponding to International Application No. PCT/US2008/063020; Mailing Date: Jul. 21, 2008.
International Search Report and Written Opinion corresponding to International Application No. PCT/US2007/012706; Mailing Date: Jul. 3, 2008.
Krames, "Lumileds Lighting, Light from Silicon Valley" Progress and Future Direction of LED Technology, SSL Workshop, Nov. 13, 2003, pp. 1-21.
Press Release from LED Lighting Fixtures dated Jan. 26, 2006 entitled "LED Lighting Fixtures Creates 750 Lumen Recessed Light and Uses Only 16 Watts of Power".
Press Release from LED Lighting Fixtures dated Feb. 16, 2006 entitled "LED Lighting Fixtures, Inc. Announces Record Performance".
Press Release from LED Lighting Fixtures dated Apr. 24, 2006 entitled "LED Lighting Fixtures, Inc. achieves unprecedented gain in light output from new luminaire".
Press Release from LED Lighting Fixtures dated May 30, 2006 entitled "LED Lighting Fixtures, inc. Sets World Record at 80 Lumens per Watt for Warm White Fixture".
Press Release from LED Lighting Fixtures dated Feb. 7, 2007 entitled "LED Lighting Fixtures Announces its First LED-based Recessed Down Light".
Press Release from LED Lighting Fixtures dated May 4, 2007 entitled "LED Lighting Fixtures to Expand Product Line".
Press Release from LED Lighting Fixtures dated Nov. 28, 2007 entitled "New Lamp from LED Lighting Fixtures Shatters World Record for Energy Efficiency".
Shimizu, "Development of High-Efficiency LED Downlight", First International Conference on White LEDs and Solid State Lighting.
U.S. Department of Energy, "DOE Solid-State Lighting CALiPER Program, Summary of Results: Round 3 of Product Testing", Oct. 2007.
U.S. Department of Energy, "DOE Solid-State Lighting CALiPER Program, Summary of Results: Round 4 of Product Testing", Jan. 2008.
U.S. Department of Energy, "DOE Solid-State Lighting CALIPER Program, Summary of Results: Round 5 of Product Testing", May 2008.
Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting.

* cited by examiner

| LUMINOSITY BINS | | |
|---|---|---|
| BIN | MIN (mcd) | MAX (mcd) |
| V1 | 1600 | 1700 |
| V2 | 1700 | 1810 |
| V3 | 1810 | 1930 |

| BIN USAGE PRIORITY | |
|---|---|
| 1 | A1 |
| 2 | A9 |
| 3 | A2 |
| 4 | A8 |
| ↓ | ↓ |
| 33 | D4 |
| 34 | C4 |
| 35 | C5 |
| 36 | D5 |

FIGURE 12

| COMBINATION PRIORITY | | | | | | | | |
|---|---|---|---|---|---|---|---|---|
| COMBINATION PRIORITY NO. | BIN 1 | | BIN 2 | | AVG. MIX | | | MIX BIN |
| | COLOR1 | lv 1 | COLOR2 | lv 2 | X | Y | lv MIN | |
| 1 | A1 | V1 | D6 | V3 | 0.2799 | 0.2614 | 1705 | C4 |
| 2 | A9 | V1 | D1 | V3 | 0.2837 | 0.2665 | 1705 | C4 |
| 3 | A9 | V1 | D1 | V2 | 0.2841 | 0.2675 | 1650 | C4 |
| 4 | A9 | V1 | D1 | V1 | 0.2844 | 0.2684 | 1600 | C4 |
| ↓ | ↓ | ↓ | ↓ | ↓ | ↓ | ↓ | ↓ | ↓ |
| N | A2 | V1 | D5 | V3 | 0.2801 | 0.2615 | 1705 | C5 |

FIGURE 13

APPARATUS AND METHODS FOR COMBINING LIGHT EMITTERS

RELATED APPLICATIONS

The present application is a divisional of and claims priority from U.S. application Ser. No. 12/057,748, filed Mar. 28, 2008, now U.S. Pat. No. 8,350,461, entitled "APPARATUS AND METHODS FOR COMBINING LIGHT EMITTERS," which is assigned to the assignee of the present application, the disclosure of which is hereby incorporated herein by reference as if set forth fully.

FIELD OF THE INVENTION

The present invention relates to lighting, and more particularly to selecting lighting components used in lighting assemblies.

BACKGROUND

Panel lighting assemblies are used for a number of lighting applications. A lighting panel may be used, for example, for general illumination or as a backlighting unit (BLU) for an LCD display. Lighting panels commonly employ an arrangement of multiple light emitters such as fluorescent tubes and/or light emitting diodes (LED). An important attribute of the multiple light emitters may include uniformity of color and/or luminance in displayed output. Presently, light emitters may be tested and grouped and/or binned according to their respective output and/or performance characteristics. The grouping may be performed using, for example, chromaticity values, such as the x, y values used in the CIE 1931 color space that was created by the International Commission on Illumination in 1931. In this manner, each light emitter may be characterized by x, y coordinates. Emitters having similar x, y values may be grouped or binned to be used together. However, selecting emitters from one or a few bins to provide specific chromaticity and/or luminosity characteristics may reduce the usable portion of a batch of emitters, potentially resulting in inefficiency, waste, and/or increased manufacturing costs.

SUMMARY

Some embodiments of the present invention provide methods for selecting combinations of multiple light emitters. Some embodiments of methods include grouping the emitters into multiple bins corresponding to multiple emitter group regions in a multiple axis color space and multiple luminosity ranges, each of the emitter group regions defining a range of chromaticities distinct from chromaticities of other of the emitter group regions, each of the bins corresponding to a different combination of one of the luminosity ranges and one of the emitter group regions. Methods may include determining multiple chromaticities corresponding to a center point in each of the emitter group regions, each of the chromaticities including multiple chromaticity component values corresponding to the multiple axis color space and defining a desired color region in the multiple axis color space. Methods may include estimating a combined chromaticity corresponding to a combination center point for each of multiple N-bin combinations, N defining the number of bins that are combined to estimate each of the combination center points, estimating a combined luminosity corresponding to the combination center point for each of the N-bin combinations, and comparing the combined chromaticity of each of the combination center points to the desired color region. Methods may include selecting combinations of the light emitters responsive to comparing the combined chromaticity of each of the combination center points to the desired color region.

Some embodiments include comparing the combined luminosity of each of the combination center points to a specified luminosity range and selecting combinations of the light emitters responsive to comparing the combined luminosity of each of the combination center points. Some embodiments include discarding a non-compliant portion of the combination center points that are not within the specified luminosity range.

Some embodiments include discarding a non-compliant portion of the combination center points that are not within the desired color region. In some embodiments, N is two and estimating the combined chromaticity and luminosity corresponding to each of the combination center points includes estimating the combined chromaticity and luminosity for two-emitter group region combinations.

Some embodiments include identifying a portion of the bins that include center point chromaticities that are substantially different from a target chromaticity point in the desired color region and ranking the identified portion of the bins at a high matching priority relative to other of the bins.

Some embodiments include prioritizing each of the combination center points as a function of corresponding ones of the bins. In some embodiments, prioritizing includes ranking the combination center points corresponding to a difference between a bin center point included in the combination center point and a target chromaticity point.

Some embodiments include prioritizing each of the combination center points corresponding to a difference between ones of the combination center points and a target chromaticity point. Some embodiments may include estimating the target chromaticity point as a function of a design specification. Some embodiments may include estimating the target chromaticity point as an inventory chromaticity center point that is based on an emitter inventory that includes the light emitters. In some embodiments, estimating the target chromaticity point includes estimating the inventory chromaticity center point corresponding to an aggregate chromaticity and luminosity of light emitters in the emitter inventory.

In some embodiments, prioritizing the combination center points further includes ranking ones of the combination center points corresponding to a distance to the target chromaticity point. In some embodiments, prioritizing the combination center points includes ranking ones of the combination center points corresponding to multiple concentric regions centered at the target chromaticity point, the regions including an aspect ratio substantially similar to an aspect ratio of ones of the emitter group regions. In some embodiments, prioritizing the combination center points includes ranking ones of the combination center points corresponding to multiple concentric regions centered at the target chromaticity point, the regions including an aspect ratio substantially similar to an aspect ratio of a bounded area corresponding to distribution data of emitter inventory bin data.

Some embodiments include prioritizing the bins corresponding to a difficulty in combining emitters in each of the bins relative to other ones of the bins. In some embodiments, the difficulty in combining emitters in each of the bins corresponds to distribution data of the light emitters relative to the bins.

In some embodiments, the multiple axis color space includes International Commission on Illumination (CIE) 1931 that expresses a chromaticity as an ordered pair x, y and luminosity as Y, a first emitter group region center point is represented by x1, y1, and Y1 and a second emitter group region center point is represented by x2, y2, and Y2. In some embodiments, a combination center point is expressed as x, y, and Y, x and y are each functions of x1, y1, Y1, x2, y2, and Y2, and Y is a function of Y1 and Y2.

Some embodiments of the present invention include a computer program product for selecting combinations of a plurality of light emitters, the computer program product comprising a computer usable storage medium having computer readable program code embodied in the medium, the computer readable program code configured to carry out the methods disclosed herein.

Some embodiments of the present invention include devices including multiple light emitters, a portion of which are grouped responsive to a combined chromaticity of a portion of multiple bins that are defined corresponding to multiple emitter group regions in a multiple axis color space and multiple luminosity ranges. In some embodiments, each of the bins includes a center point corresponding to chromaticity and luminosity values. In some embodiments, the combined chromaticity includes chromaticity values estimated from a first chromaticity and a first luminosity corresponding to a first bin and a second chromaticity and a second luminosity corresponding to a second bin. In some embodiments, the combined chromaticity includes chromaticity values that are within a desired color region in the multiple axis color space.

In some embodiments, the bins are prioritized by proximity to a desired color region in the multiple axis color space. In some embodiments, a first emitter group region that corresponds to a first bin is more proximate the desired color region than a second emitter group region that corresponds to a second bin and the second bin includes a high priority relative to the first bin.

In some embodiments, the light emitters are selected from a batch of light emitters that are grouped into the bins and each of the bins includes a center point including center point chromaticity values and center point luminosity values. In some embodiments, the combined chromaticity includes an additive mixing of center point chromaticity values and center point luminosity values corresponding to at least two of the bins. In some embodiments, the combined chromaticity includes chromaticity values that correspond to a desired color region.

In some embodiments, multiple combination center points corresponding to at least two of the bins are prioritized based on a target chromaticity point in a desired color region. In some embodiments, the light emitters are selected from an inventory of light emitters that are grouped into the bins and the combination center points are prioritized corresponding to multiple substantially concentric regions centered at the target chromaticity point, the regions including an aspect ratio substantially similar to an aspect ratio of a bounded area corresponding to distribution data of the inventory of light emitters. In some embodiments, the light emitters are selected from an inventory of light emitters that are grouped into the bins and the target chromaticity point includes an inventory chromaticity center point corresponding to an aggregate chromaticity and luminosity of the inventory of light emitters.

Some embodiments of the present invention include apparatus for combining multiple light emitters that are grouped into multiple bins corresponding to multiple emitter group regions in a multiple axis color space and multiple luminosity ranges. Such apparatus may include a combination module that is configured to generate a list of multiple combinations of at least two of the bins that include a combined center point within a desired color region. Apparatus may include a prioritization module that is configured to generate a priority list corresponding to the bins and a selection module that is configured to select a portion of the bins from which to combine light emitters.

In some embodiments, the prioritization module is configured to prioritize the plurality of bins to identify which of the combinations of the at least two of the plurality of bins to select first. In some embodiments, the desired color region includes a chromaticity target point and the prioritization module is further configured to prioritize the combinations based on the combined center point relative to the chromaticity target point. In some embodiments, the chromaticity target point includes an aggregate value corresponding to an emitter inventory from which the emitters are selected.

In some embodiments, the combination module is further configured to compare the list of at least two bin combinations to the desired color region and to discard the at least two bin combinations that include combined center points outside the desired color region.

Some embodiments of the present invention include methods of selecting combinations of multiple light emitters that are grouped into multiple bins corresponding to multiple emitter group regions in a multiple axis color space and multiple luminosity ranges. Such methods may include prioritizing multiple combinations of light emitters from at least two of the bins, each of the combinations including chromaticity values corresponding to a desired color region and a luminosity value corresponding to a specified luminosity range.

In some embodiments, prioritizing the combinations of light emitters is based on characteristics of one of the at least two of the bins. In some embodiments, prioritizing the combinations of light emitters includes estimating an emitter inventory chromaticity corresponding to an emitter inventory including the emitters. In some embodiments, prioritizing the combinations of light emitters further includes ranking the combinations corresponding to multiple target regions that are substantially centered around the emitter inventory chromaticity.

BRIEF DESCRIPTION OF THE DRAWINGS

The accompanying drawings, which are included to provide a further understanding of the invention and are incorporated in and constitute a part of this application, illustrate certain embodiment(s) of the invention.

FIG. 12 is a table illustrating bin usage priority according to some embodiments of the present invention.

FIG. 13 is a table illustrating combination priorities according to some embodiments of the present invention.

DETAILED DESCRIPTION OF EMBODIMENTS OF THE INVENTION

Figure 1:
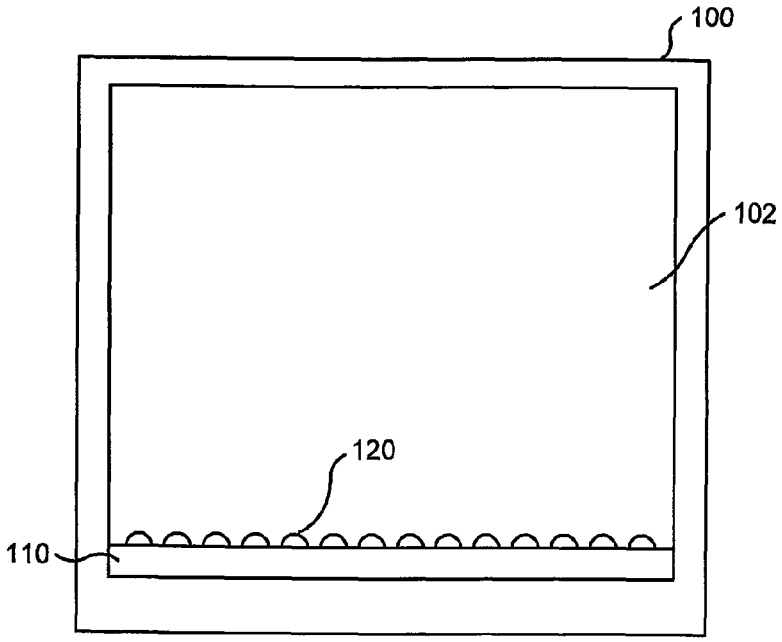
FIG. 1 is a schematic diagram of a front cut-away view illustrating a device including a plurality of light emitters that are grouped according to some embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be stored or implemented in a microcontroller, microprocessor, digital signal processor (DSP), field programmable gate array (FPGA), a state machine, programmable logic controller (PLC) or other processing circuit, general purpose computer, special purpose computer, or other programmable data processing apparatus such as to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Reference is now made to FIG. 1, which is a schematic diagram of a front cut-away view illustrating a device 100 including multiple light emitters 120 that are grouped according to some embodiments of the present invention. In some embodiments, the device 100 may include a display 102 that uses one or more lighting assemblies 110. As illustrated in the cut-away view of FIG. 1, portions of the display 102 and/or lighting assembly 110 that would ordinarily obscure the illustrated portion of the lighting assembly 110 from a front view may not be illustrated. A lighting assembly 110 may include multiple light emitters 120. In some embodiments, a lighting assembly 110 may be an edge lighting assembly, as illustrated in FIG. 1. In some embodiments, a device 100 may use multiple light emitters 120 in applications other than display backlighting.

Figure 2:
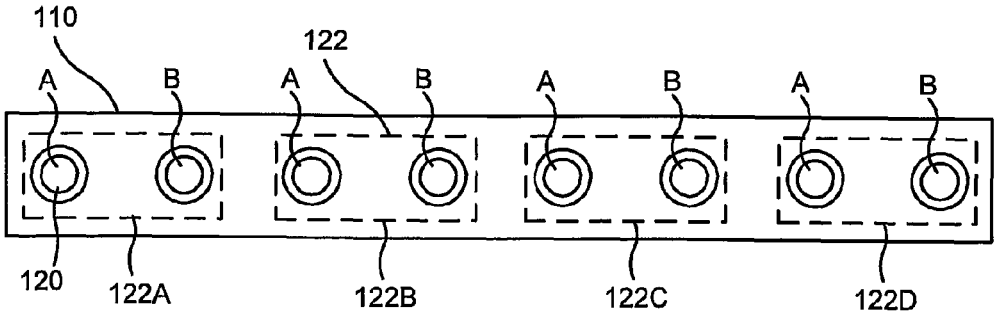
FIG. 2 is a schematic diagram illustrating the lighting assembly as illustrated in FIG. 1 according to some embodiments of the present invention.

Reference is now made to FIG. 2, which is a schematic diagram illustrating the lighting assembly 110 as illustrated in FIG. 1 according to some embodiments of the present invention. The lighting assembly 110 includes multiple light emitters 120 that grouped responsive to the combined chromaticity and/or luminosity values of two alternating groups of light emitters 120. As shown in FIG. 2, two alternating groups of light emitters 120 are labeled group A and group B. The light emitters 120 are grouped into pairs 122, referred to as metameric pairs 122A-122D. Chromaticities of the light emitters 120 of the metameric pairs 122A-122D may be selected so that the combined light generated by a mixture of light for each of the light emitters 120 of the metameric pairs 122A-122D may include light having a desired chromaticity. In this manner, the perceived color of combined sources, even substantially non-white sources, may be white based on the apparent chromaticity of the combination. In some embodiments, the luminosity of the light emitters 120 of the metameric pairs 122A-122D may be selected so that the combined light generated by the mixture of light includes light emitted at desired luminosity levels.

Figures 3, 4:
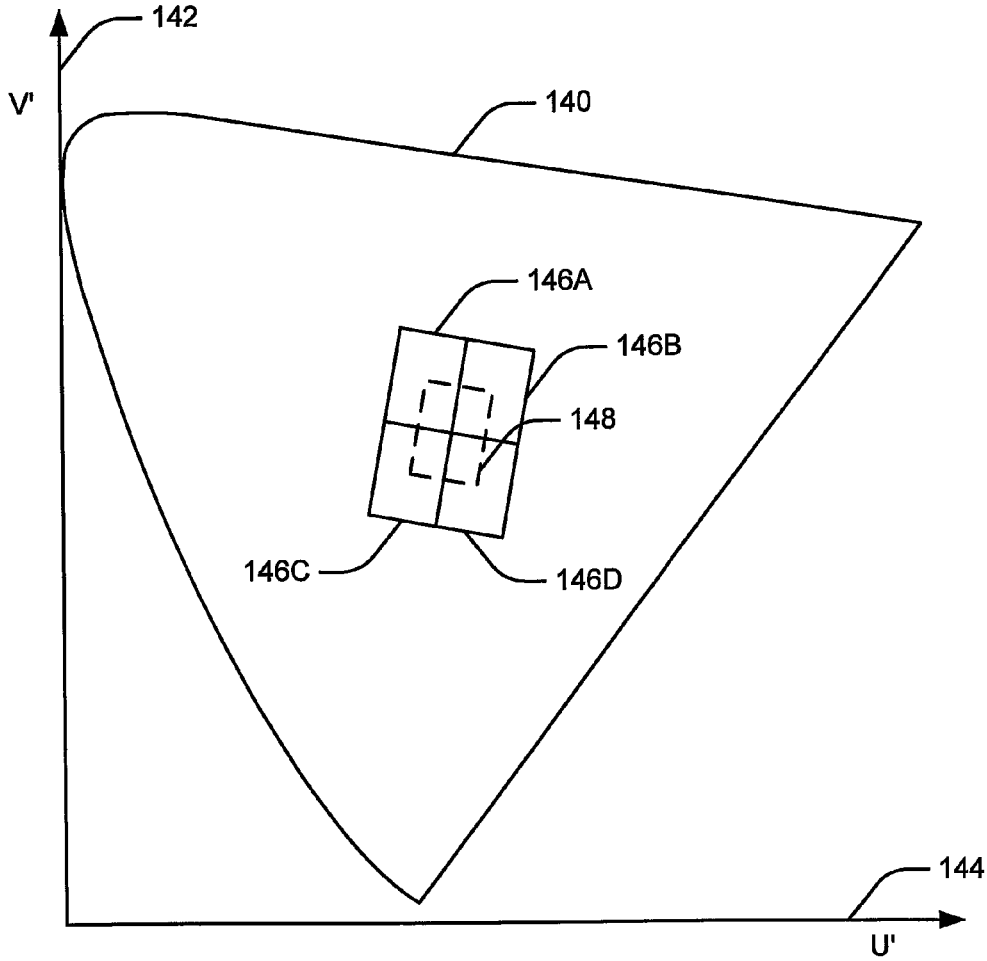
FIG. 3 is a color space chromaticity diagram illustrating multiple regions corresponding to multiple groups of emitters having similar chromaticity coordinates according to some embodiments of the present invention.
FIG. 4 is a table illustrating luminosity bin values according to some embodiments of the present invention.

For example, brief reference is made to FIG. 3, which is a color space chromaticity diagram illustrating multiple regions 146A-146D corresponding to multiple groups of emitters having similar chromaticity coordinates according to some embodiments of the present invention. The multiple axis color space may be a 1976 CIE chromaticity space, as illustrated in FIG. 3 or may include a 1931 CIE chromaticity space as discussed herein. As illustrated in FIG. 3, the color space 140 may be defined in terms of u' and v' axes 144, 142 such that any point in the color space may be expressed as a coordinate pair (u', v'). Combined light from metameric pairs 122A-122D may be within a desired color region 148. For example, group A and group B light emitters 120 from FIG. 2 may include light emitters from emitter group regions 146C and 146B, respectively. In this manner, an adjacent pair of light emitters A and B may be selected based on their actual chromaticity points being about equidistant from the desired chromaticity region 148, or being in emitter group regions 146A-146D that are about equidistant from the desired chromaticity region.

In addition to chromaticity, luminosity may be considered in grouping the light emitters 120. For example, reference is now made to FIG. 4, which is a table illustrating luminosity bin values according to some embodiments of the present invention. The light emitters 120 may be grouped according to their luminosity using multiple luminosity ranges. For example, three luminosity bins identified as V1, V2, and V3 may correspond to ranges 1600 mcd to 1700 mcd, 1700 mcd to 1810 mcd, and 1810 mcd to 1930 mcd, respectively. In this manner, emitter groups may be defined as a specific emitter group region at a specific luminosity. For example, according to FIGS. 3 and 4, an emitter group may include all light emitters 120 having chromaticity corresponding to emitter group region 146C and luminosity V2. Thus, the light emitters 120 may be grouped responsive to a combined chromaticity of a portion of multiple bins that may be defined corresponding to multiple emitter group regions in a multiple axis color space and multiple luminosity ranges.

Figure 5:
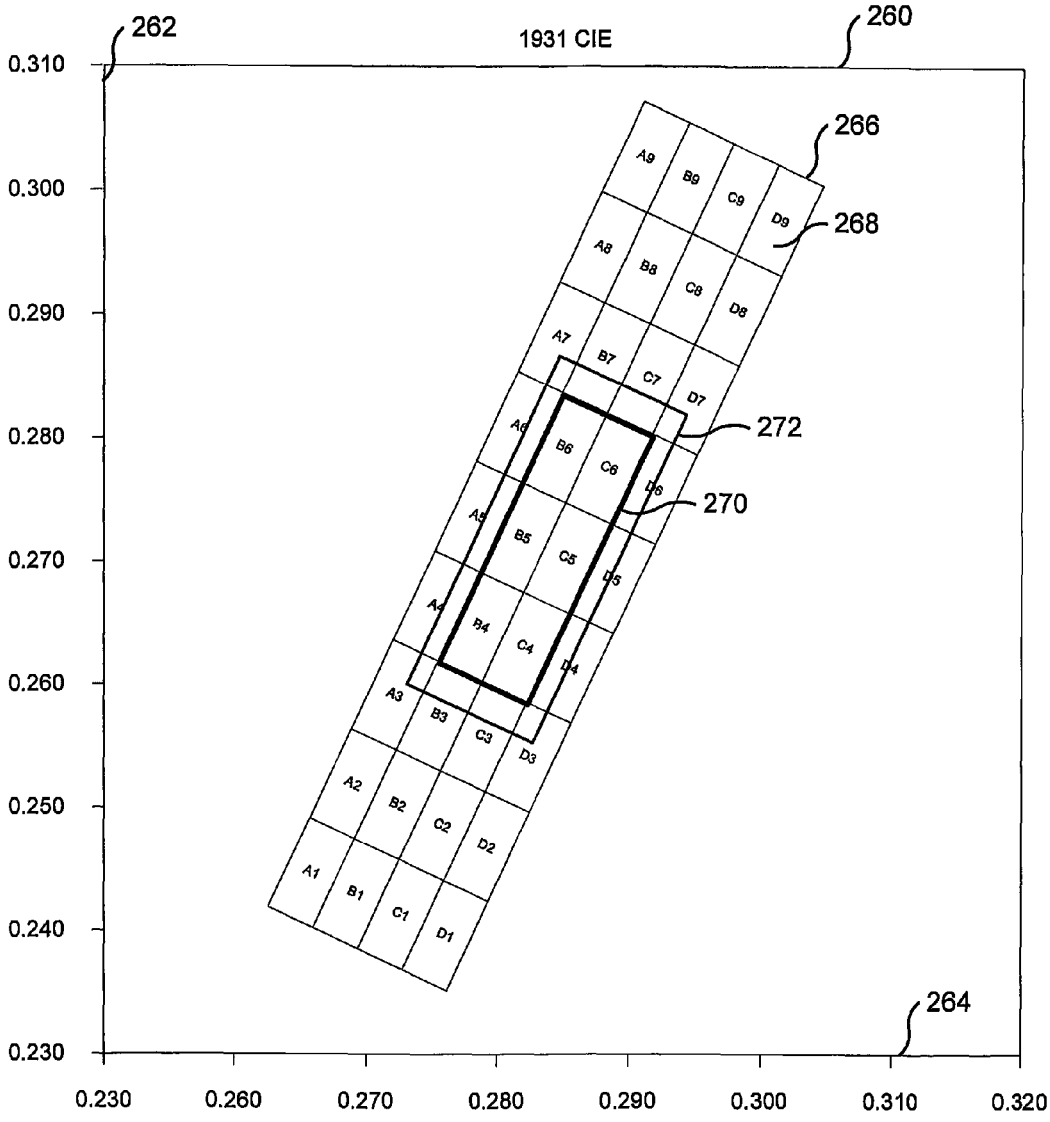
FIG. 5 is a color space chromaticity diagram illustrating multiple emitter group regions and a desired color region according to some embodiments of the present invention.

Reference is now made to FIG. 5, which is a color space chromaticity diagram illustrating multiple emitter group regions and a desired color region according to some embodiments of the present invention. A portion of 1931 CIE color space 260 includes an x axis 264 and a y axis 262. Light emitters 120 may be sorted into multiple emitter group regions 268 according to the chromaticity of light emitted therefrom. In some embodiments, the emitter group regions 268 may correspond to a color space portion 266 that is within a region that is generally considered to be white. A desired color region 270 may include a region of the color space 260 that is specified corresponding to a design specification and/or a particular application. In some embodiments, the desired color region 270 may be expressed in terms of chromaticity coordinates. Some embodiments provide that the desired color region 270 may be defined in terms of group emitter regions and/or color bins. In some embodiments, a tolerance color region 272 may be larger than the desired color region 270 due to variations between individual emitters within each of the emitter group regions 268.

In some embodiments, each of the emitter group regions 268 may include a center point that may be determined as a function of chromaticity values. Some embodiments provide that, within each bin, the emitters may be further grouped corresponding to luminosity. In this regard, each of the bins may be expressed, for example, in terms of x, y, and Y, such that chromaticity of each of the bins may be expressed as center point x, y coordinates and the luminosity may be expressed as Y.

A combined chromaticity corresponding to emitters from two bins may be determined using the chromaticity and luminosity center point values corresponding to the two bins. For example, the combined chromaticity component values for mixing two bins, bin 1 and bin 2, may be calculated as:

$$x = \frac{x1 * m1 + x2 * m2}{m1 + m2}; \text{ and } y = \frac{y1 * m1 + y2 * m2}{m1 + m2},$$

such that x1 and y1 are chromaticity center point values of bin 1, and x2 and y2 and chromaticity center point values of bin 2. Intermediate values m1 and m2 may be used to incorporate the center point luminosity values Y1 and Y2 of bins 1 and 2, respectively, into the combined chromaticity component values and may be determined as:

$$m1 = \frac{Y1}{y1}; \text{ and } m2 = \frac{Y2}{y2}.$$

In some embodiments, a combined luminosity corresponding to the combination of bins 1 and 2 may be determined as:

$$Y = Y1 + Y2.$$

In some embodiments, combinations that produce a luminosity below a specified range may be discarded. In some embodiments, the luminosity values of the bins are such that a combined luminosity is necessarily within a specified range. For example, if the minimum bin luminosity is V1 and the specified range includes V1 luminosities, then all of the combinations necessarily are within the specified range. Although the disclosure herein specifically addresses two bin combinations, the invention is not thus limited. For example, combinations including three or more bins may also be used according to the methods, devices and apparatus disclosed herein.

After filtering out combinations based on luminosity, if necessary, the combined chromaticity of each two-bin combination may be compared to a desired color region 270 to determine which of the combinations to discard. For example, if a combined chromaticity is located in emitter group region A3 then that combination may be discarded. In this manner, the combinations that provide sufficient luminosity and chromaticity may be considered when selecting the light emitters 120 from corresponding ones of those bins.

In some embodiments, the multiple bins may be prioritized based on, for example, proximity to the desired color region 270. For example, bins that are less proximate the desired color region may be assigned a higher priority than bins that are more proximate the desired color region. In this manner, a bin having a center point in emitter group region A9 may be assigned a higher priority than a bin having a center point in emitter group region C3. In some embodiments, combination center points may then be prioritized corresponding to the bin priorities.

Some embodiments provide that the combination center points may be prioritized based on locations of the combination center points relative to a target chromaticity point in the desired color region 270. In some embodiments, the target chromaticity may be dependent on the geometry of desired color region, such as, for example, a center and/or other focus point of the desired color region 270. In some embodiments, the light emitters 120 are selected from a batch or inventory of light emitters that are grouped into the bins and the target chromaticity point may correlate to chromaticity and/or luminosity data of the emitter inventory.

Figure 6:
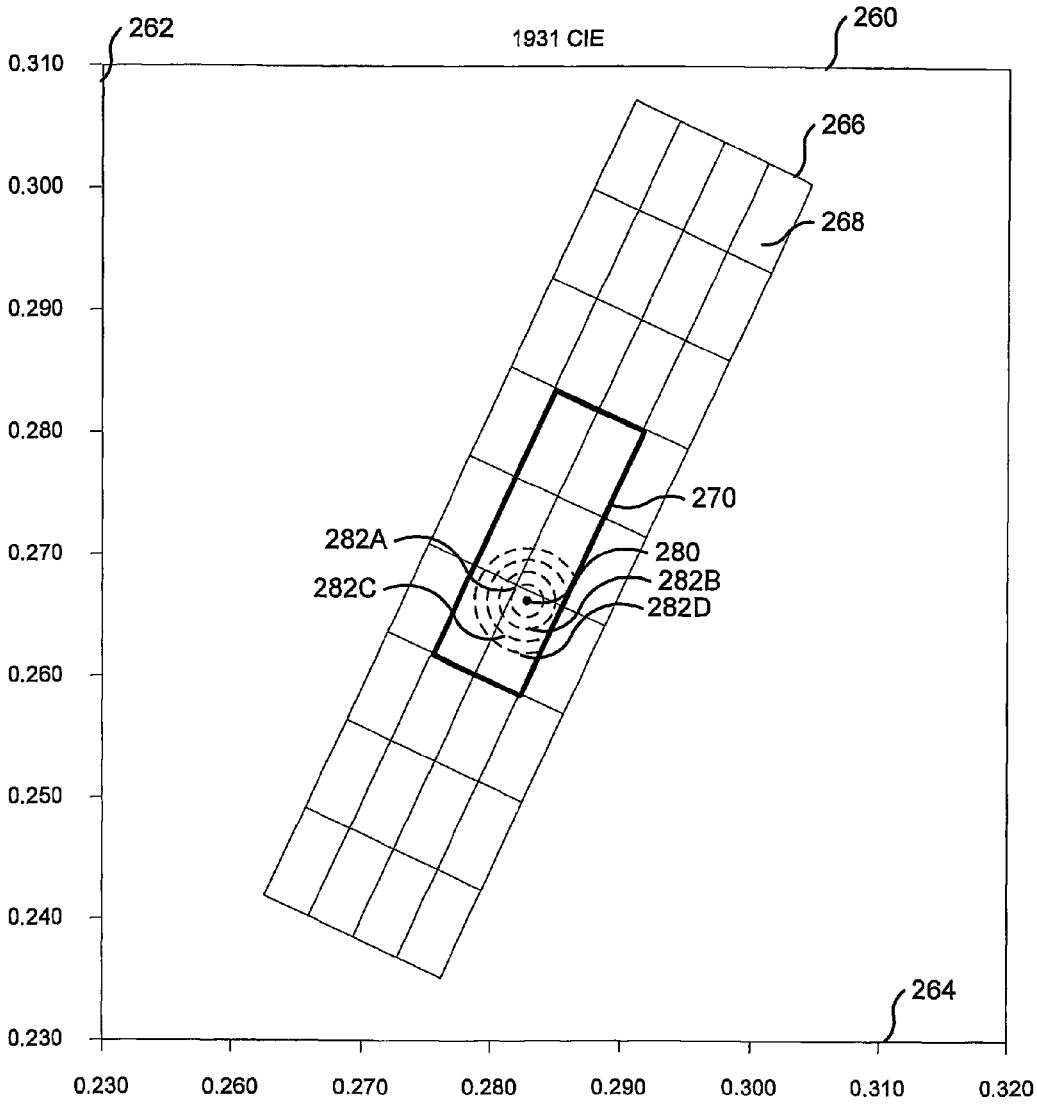
FIG. 6 is a color space chromaticity diagram illustrating combination prioritization using an inventory center point according to some embodiments of the present invention.

Reference is now made to FIG. 6, which is a color space chromaticity diagram illustrating combination prioritization using an inventory center point according to some embodiments of the present invention. As discussed above regarding FIG. 5, a portion of 1931 CIE color space 260 includes an x axis 264 and a y axis 262 that may provide coordinates for defining multiple emitter group regions 268. A desired color region 270 may be defined and a target chromaticity point 280 may be determined. As discussed above regarding FIG. 5, the target chromaticity point 280 may be determined by chromaticity and/or luminosity data of the emitter inventory.

In some embodiments, the target chromaticity point 280 may correspond to an inventory center point that may be determined as an aggregate chromaticity and luminosity of the inventory of light emitters 120. In some embodiments, the inventory center point may be determined from the previously calculated bin center points. For example, for an inventory that is grouped into i emitter group regions and having j luminosity ranges, inventory center point coordinate values may be determined by:

$$x_o = \frac{\sum_i m_i x_i}{\sum_i m_i}; \text{ and } y_o = \frac{\sum_i m_i y_i}{\sum_i m_i},$$

such that x and y are the emitter group region center points for the i emitter group regions. The intermediate variable $m_i$ may incorporate luminosity and may be determined as:

$$m_i = \frac{\sum_j Y_j n_{ij}}{y_i},$$

where $n_{ij}$ is the quantity of light emitters in color bin i and luminosity bin j. In some embodiments, the value $Y_j$ may represent the minimum luminosity value corresponding to the respective luminosity range. In this manner, a chromaticity target point 280 that corresponds to the bin data distribution of the emitter inventory may be determined. In some embodiments, the inventory center point may be calculated using similar approaches directly from the chromaticity and/or luminosity data of each of the light emitters in the emitter inventory without using the bin center points.

In some embodiments, the combined center points may be prioritized independent of bin priority. For example, some embodiments provide that the combination center points may be prioritized according to distance from the target chromaticity point 280. A distance between a combined center point (x, y) and the target chromaticity point ($x_o$, $y_o$) may be determined by:

$$\Delta xy = \sqrt{(x-x_o)^2+(y-y_o)^2}.$$

In some embodiments, the combination center points may be prioritized using priority regions 282A-282D that are substantially concentric to the target chromaticity point and have an increasing radius. In this manner, all of the combinations corresponding to combination center points within the first priority region 282A will have a highest priority. Accordingly, the next highest priority will be assigned to combination corresponding to combination center points that are within the second priority region 282B. In addition to satisfying a distance requirement corresponding to a particular priority region, combination center points that are outside the desired color region 270 are not included since these combinations are not considered for prioritization. In some embodiments, the combinations with combined center points outside the color region may be discarded during the prioritization and/or as a separate operation prior to the prioritization.

Figure 7:
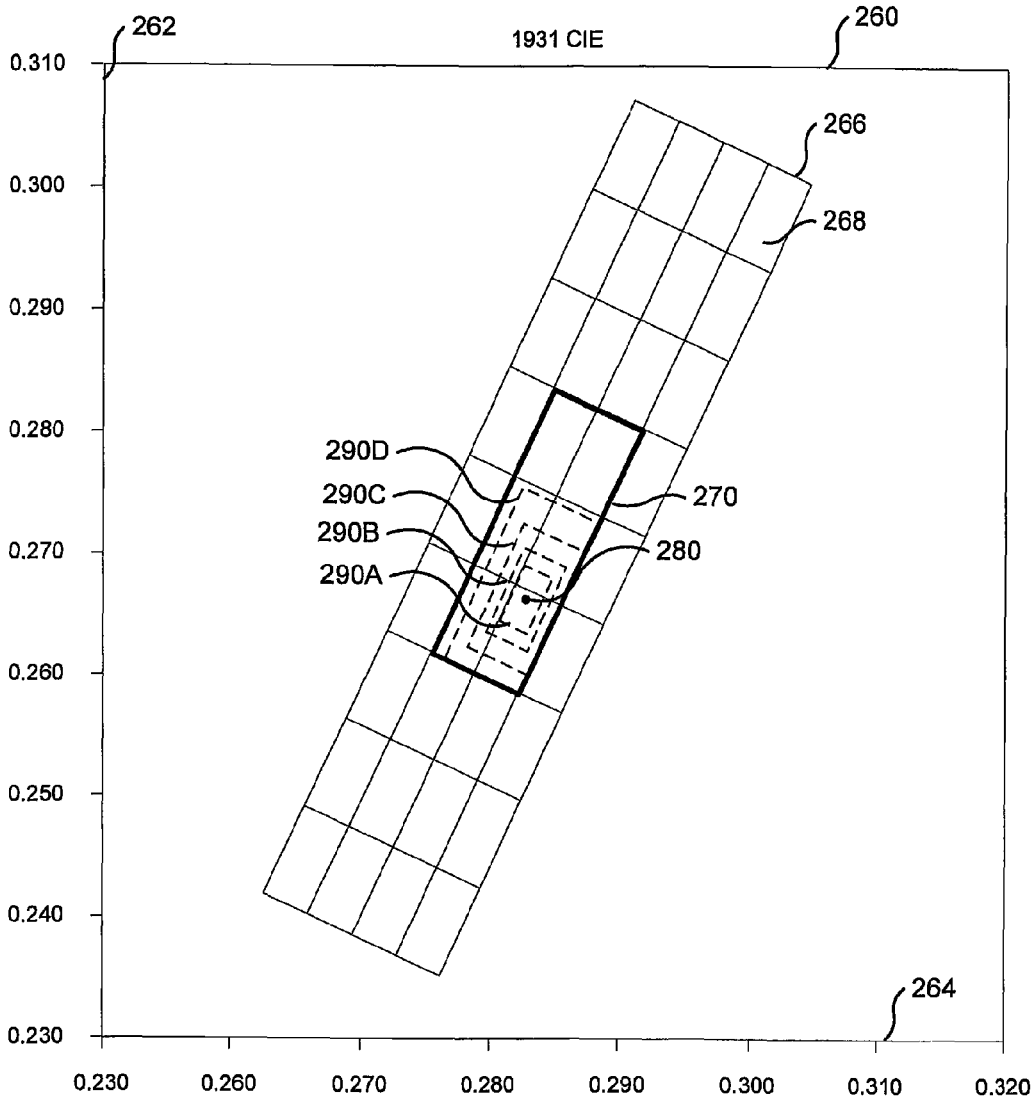
FIG. 7 is a color space chromaticity diagram illustrating combination prioritization using an inventory center point according to some embodiments of the present invention.

Reference is now made to FIG. 7, which is a color space chromaticity diagram illustrating combination prioritization using an inventory center point according to some embodiments of the present invention. In some embodiments, target chromaticity point may provide a reference point for priority regions 290A-290D that are configured in a substantially rectangular geometry. Some embodiments provide that the priority regions 290A-290D include an aspect ratio that is substantially similar to that of the emitter group regions 268. For example, if emitter group regions 268 include a substantially 2:1 aspect ratio and are oriented at a particular angle relative to the axes 264, 262, then the priority regions 290A-290D may include substantially the same aspect ratio and/or orientation angle. In this manner, priority regions 290A-290D may be correlative to the grouping of the light emitters.

Figure 8:
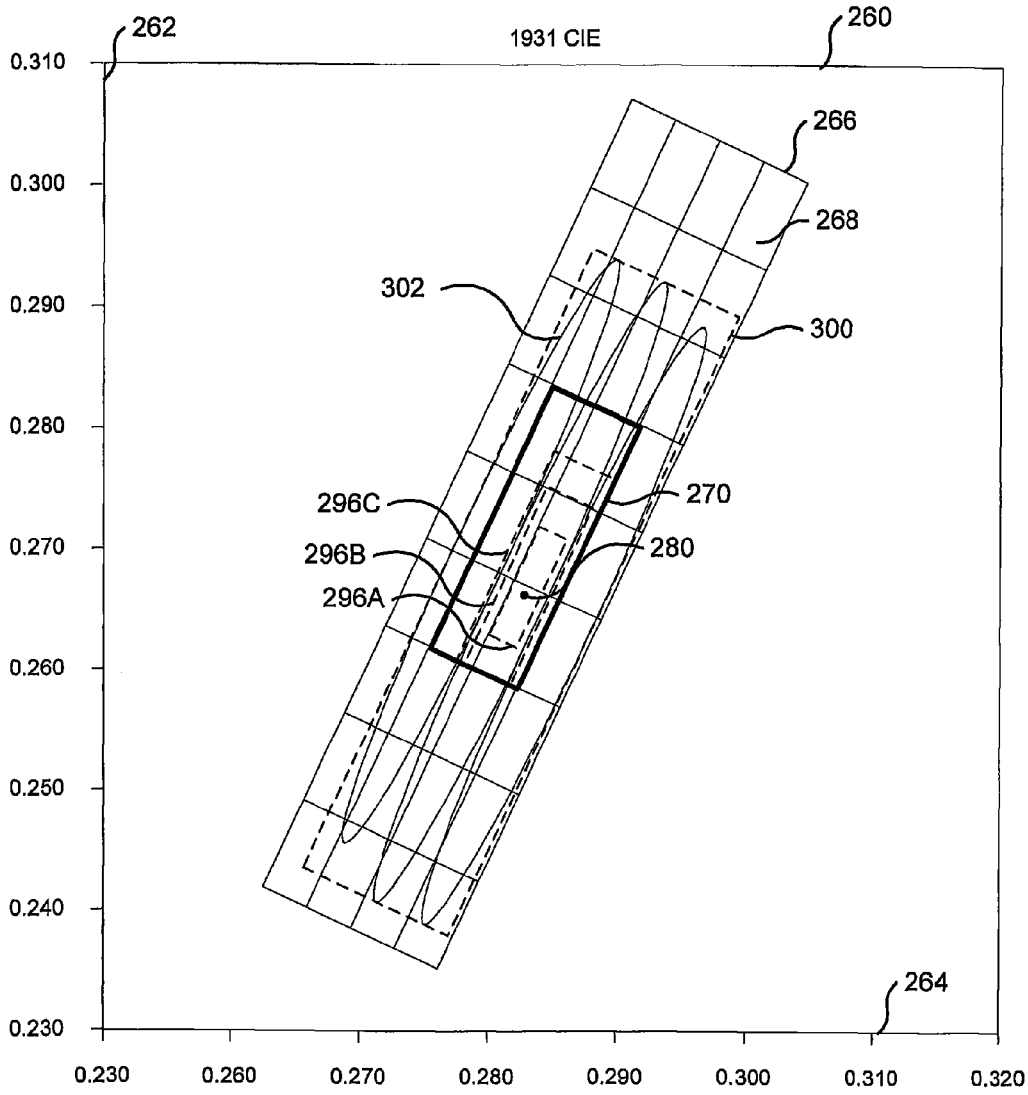
FIG. 8 is a color space chromaticity diagram illustrating combination prioritization using an inventory center point according to some embodiments of the present invention.

Some embodiments provide that the aspect ratio may be configured according to the emitter inventory. For example, referring to FIG. 8, which is a color space chromaticity diagram illustrating combination prioritization using an inventory center point 280 according to some embodiments of the present invention, the priority regions 296A-296D may include an aspect ratio that corresponds to the distribution of the emitter inventory. For example, the distribution of the emitter inventory may be generally represented by elliptical distribution regions 302. A distribution boundary 300 may be generated that bounds the elliptical distribution regions 302. In this manner, the priority regions 296A-296D may be configured to include an aspect ratio that is substantially similar to that of the distribution boundary 300. In this manner the priority regions 296A-296D may be correlative to the distribution of the emitter inventory.

Figure 9:
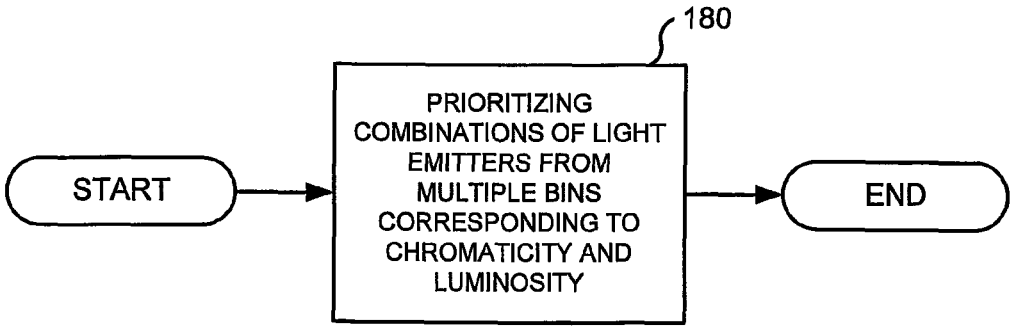
FIG. 9 is a block diagram illustrating operations for selecting combinations of light emitters that are grouped into bins corresponding to multiple emitter group regions in a multiple axis color space and multiple luminosity ranges.

Reference is now made to FIG. 9, which is a block diagram illustrating operations for selecting combinations of light emitters that are grouped into bins corresponding to multiple emitter group regions in a multiple axis color space and multiple luminosity ranges. Operations include prioritizing multiple combinations of light emitters from at least two bins, such that each combination includes chromaticity values corresponding to a desired color range and a luminosity value corresponding to a specified luminosity range (block 180). In some embodiments, prioritizing the combinations of light emitters is based on characteristics of one of the bins. For example, some embodiments provide that the bins are prioritized and that the combinations of light emitters are prioritized corresponding to the priority of one of the bins in the combination. In some embodiments, the combinations may be prioritized independent of bin priorities.

Figure 10:
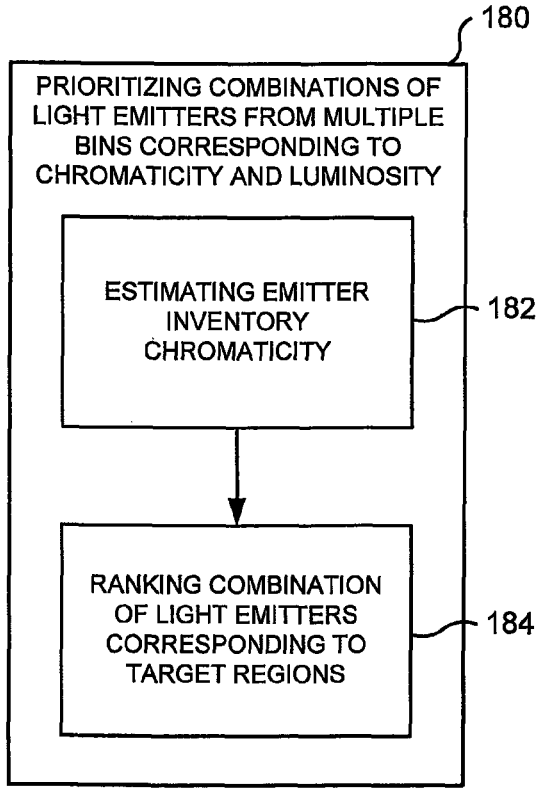
FIG. 10 is a block diagram illustrating operations for prioritizing combinations as illustrated in FIG. 9 according to some embodiments of the present invention.

Reference is now made to FIG. 10, which is a block diagram illustrating operations for prioritizing combinations as illustrated in FIG. 9 according to some embodiments of the present invention. In some embodiments, prioritizing may include estimating an emitter inventory chromaticity corresponding to the inventory of light emitters (block 182). For example, as discussed above regarding FIG. 6, an inventory center point that includes chromaticity coordinates may be determined. In some embodiments, prioritizing may include ranking the combinations corresponding to multiple target regions that are substantially centered around the emitter inventory chromaticity. For example, combinations in a smaller target region or priority region may be ranked higher in a priority list than combinations in a larger target region or priority region.

Figure 11:
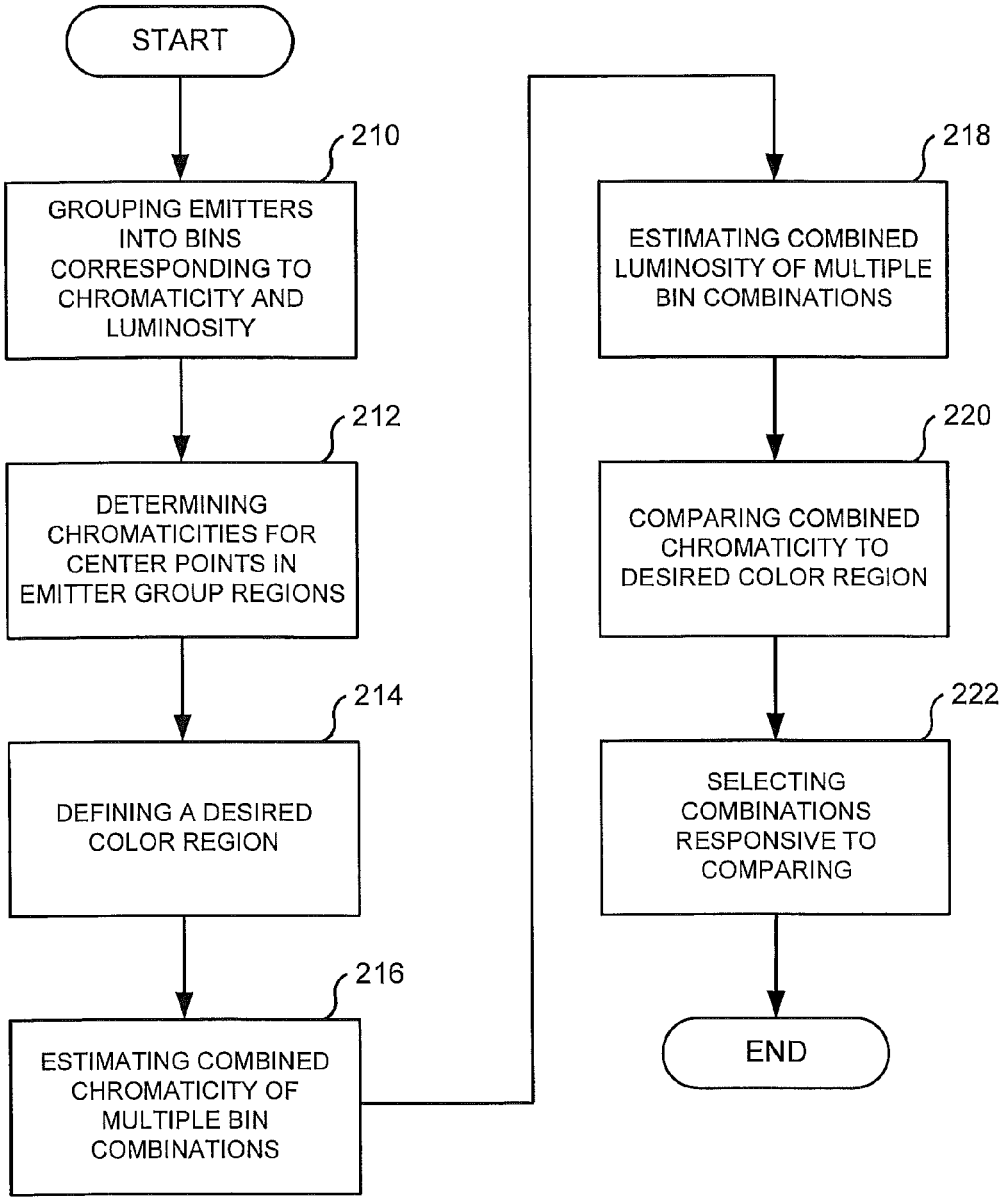
FIG. 11 is a block diagram illustrating operations for selecting combinations of multiple light emitters according to some embodiments of the present invention.

Reference is now made to FIG. 11, which is a block diagram illustrating operations for selecting combinations of multiple light emitters according to some embodiments of the present invention. Operations include grouping emitters into bins corresponding to chromaticity and luminosity (block 210). In some embodiments, luminosity may include multiple luminosity ranges. Some embodiments provide that chromaticity groups may correspond to multiple group emitter regions in a multiple axis color space. In some embodiments, each of the bins corresponds to a different combination of one of the luminosity ranges and one of the emitter group regions.

Chromaticities for center points in each of the emitter group regions may be determined (block 212). The chromaticities may include multiple chromaticity component values that correspond to the particular multiple axis color space. For example, in a CIE 1931 color space, the chromaticity component values may be expressed as x, y values. A desired color region may be defined (block 214). The desired color region may be defined as an application-specific region and/or may be defined as a function of the distribution of chromaticity and/or luminosity data in the emitter inventory.

The combined chromaticity corresponding to a combination center point for each of the N-bin combinations is estimated, such that N defines the number of bins that are combined to estimate each of the combination center points (block 216). In this manner, the combined chromaticity for each combination of the bins may be determined. The combined luminosity corresponding to the combination center point for each of the N-bin combinations is estimated (block 218).

The combined chromaticity for each of the combination center points is compared to the desired color region (block 220). In some embodiments, non-compliant ones of the combination center points that are not within the desired color region are discarded. Combinations that are within the desired color region may be selected based on the comparison to the desired color region (block 222).

Some embodiments include comparing the combined luminosity of each of the combination center points to a specified luminosity range. In this regard, combinations of the light emitters may be selected based on the luminosity comparison. In some embodiments, non-compliant ones of the combination center points may be discarded if they are not within the specified luminosity range.

Some embodiments may include identifying a portion of the bins that include center points that are substantially different from a target chromaticity point in the desired color region. In some embodiments, the bins may be ranked according to their proximity to the target chromaticity point such that those having substantially different center points from the target chromaticity point may include a higher rank.

In some embodiments, the combination center points may be prioritized as a function of corresponding ones of the bins included therein. For example, a combination center point that includes a high priority and/or difficult to match bin may be assigned a high priority relative to other combination center points having easier to match bins. In some embodiments, a combination center point may be prioritized corresponding to a difference between a bin center point in the combination center point and the target chromaticity point. In some embodiments, a combination center point may be prioritized corresponding to a difference between ones of the combination center points and the target chromaticity point. Some embodiments provide that the target chromaticity point may be estimated as a function of a design specification that may be application specific. In some embodiments, the target chromaticity point may be estimated as an inventory center point that corresponds to an emitter inventory.

Brief reference is now made to FIGS. 12 and 13, which are tables illustrating bin usage priority and combination priorities, respectively, according to some embodiments of the present invention. Referring to FIG. 12, some embodiments provide that bin usage priority may be used to determine combination priorities. For example, the bins may be assigned a priority according to difficulty in matching and/or based on chromaticity and/or luminosity distribution data of an emitter inventory. Referring to FIG. 13, the combinations may be prioritized and numbered. Each combination may be listed with the chromaticity and luminosity data of each bin in the combination. Additionally, the chromaticity center point x, y coordinates and combined luminosity may be provided, as well as, a bin identifier corresponding to the combination coordinates.

Figure 14:
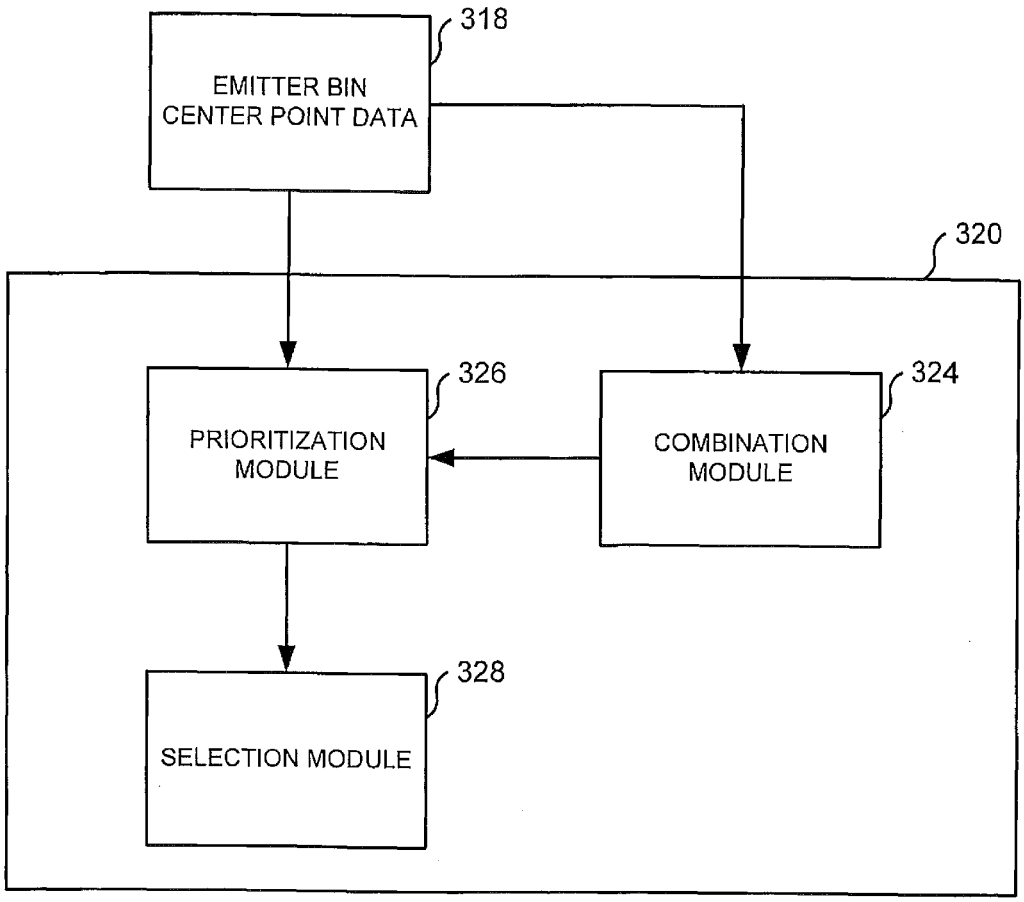
FIG. 14 is a block diagram illustrating an apparatus for combining light emitters that are grouped according to emitter group regions in a multiple axis color space and luminosity ranges according to some embodiments of the present invention.

Reference is now made to FIG. 14, which is a block diagram illustrating an apparatus 320 for combining light emitters that are grouped according to emitter group regions in a multiple axis color space and luminosity ranges according to some embodiments of the present invention. The apparatus 320 may include a combination module 324 that is configured to generate a list of the combinations of at least two of the bins that include a combined center point within a desired color region. In some embodiments, the combination module 324 may compare the list of the combinations to the desired color region and discard the combinations that include combination center points that are outside the desired color region.

A prioritization module 326 is configured to generate a priority list corresponding to the bins. In some embodiments, the prioritization module 326 is configured to prioritize the bins to identify which of the bins to select first. In some embodiments, the desired color region includes a target chromaticity point and the prioritization module is configured to prioritize the combinations based on a combined center point relative to the chromaticity target point. In some embodiments, the chromaticity target point includes an aggregate value corresponding to an emitter inventory. A selection module 328 is configured to select a portion of the bins from which to combine light emitters.

Figure 15:
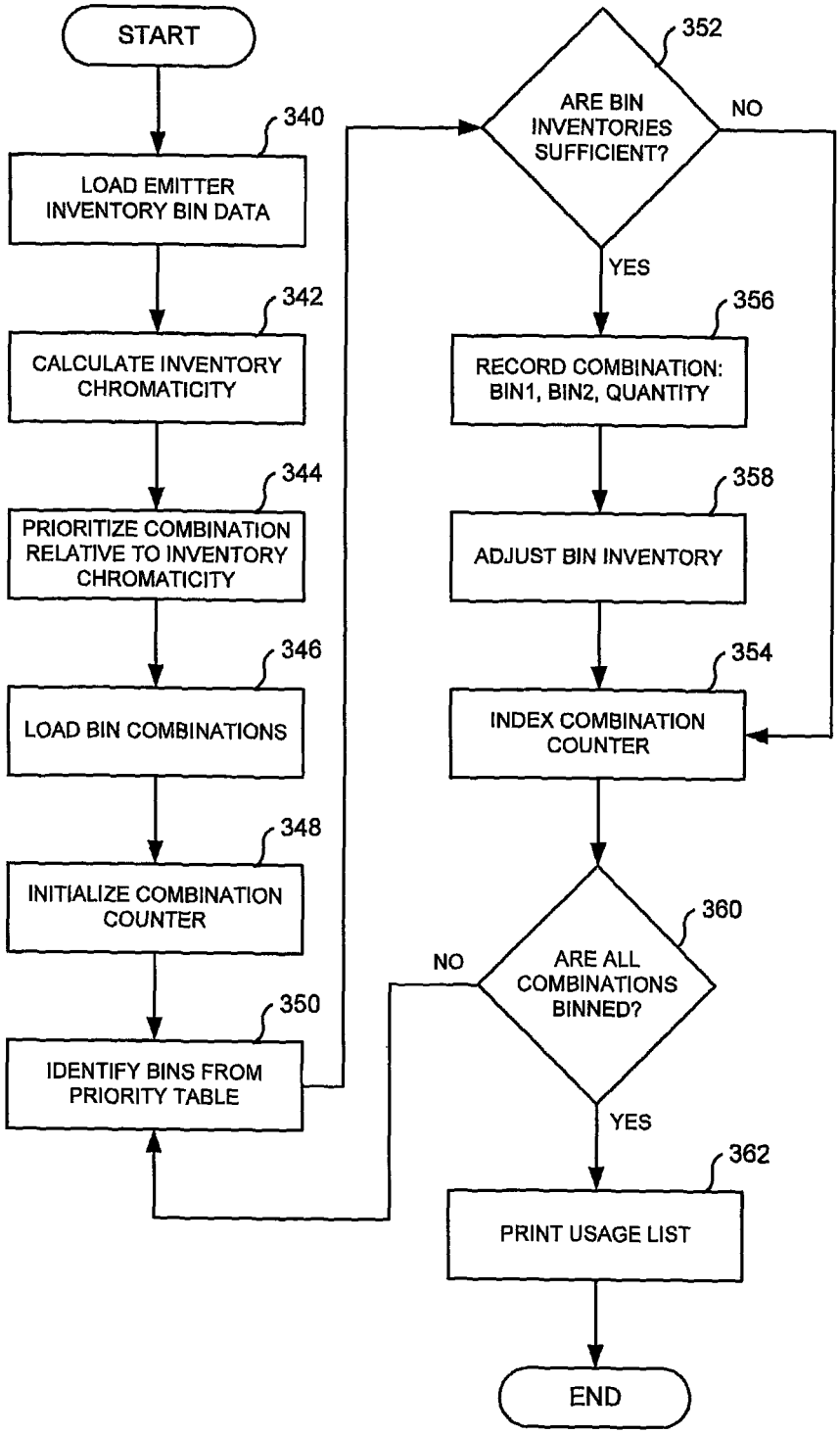
FIG. 15 is a flow chart illustrating operations for combining light emitters according to some embodiments of the present invention.

Reference is now made to FIG. 15, which is a flow chart illustrating operations for combining light emitters according to some embodiments of the present invention. Emitter inventory bin data is loaded into a processing device memory (block 340). The inventory chromaticity is calculated (block 342) and combinations are prioritized relative to the inventory chromaticity (block 344). The bin combinations corresponding to the priority list are loaded into memory (block 346) and a combination counter is initialized (block 348).

Bins corresponding to the first combination are identified (block 350) and bin inventories are checked (block 352). If the identified bins do not have sufficient inventory for the number of combinations required in a single device or sub-batch, then the combination counter is indexed (block 354). If the bins do have sufficient inventory, then the combination is recorded (block 356). The combination information may include the bin identifiers and quantities required from each bin. The bin inventory is adjusted to reflect usage of the light emitters that are used in the combination (block 358) and the combination counter is indexed (block 354).

After the combination counter is indexed, whether all combinations are binned is determined (block 360). If all combinations are binned, then a usage list is printed (block 362) and the process ends. If all combinations are not binned, then the bins for the next combination are identified from the priority table (block 350) and the process continues until all combinations are binned.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A method of selecting combinations of a plurality of light emitters, the method comprising:

grouping the plurality of emitters into a plurality of bins corresponding to a plurality of emitter group regions in a multiple axis color space and a plurality of luminosity ranges, each of the plurality of emitter group regions defining a range of chromaticities distinct from chromaticities of other of the plurality of emitter group regions, each of the plurality of bins corresponding to a different combination of one of the plurality of luminosity ranges and one of the plurality of emitter group regions;

determining a plurality of chromaticities corresponding to a center point in each of the plurality of emitter group regions, each of the plurality of chromaticities including a plurality of chromaticity component values corresponding to the multiple axis color space;

defining a desired color region in the multiple axis color space;

estimating a combined chromaticity corresponding to a combination center point for each of a plurality of N-bin combinations, N defining the number of the plurality of bins that are combined to estimate each of the combination center points;

estimating a combined luminosity corresponding to the combination center point for each of the plurality of N-bin combinations;

comparing the combined chromaticity of each of the plurality of combination center points to the desired color region; and selecting combinations of the plurality of light emitters responsive to comparing the combined chromaticity of each of the plurality of combination center points to the desired color region.

2. The method of claim 1, further comprising:

comparing the combined luminosity of each of the plurality of combination center points to a specified luminosity range; and selecting combinations of the plurality of light emitters responsive to comparing the combined luminosity of each of the plurality of combination center points.

3. The method of claim 2, further comprising discarding a non-compliant portion of the plurality of combination center points that are not within the specified luminosity range.

4. The method of claim 1, further comprising discarding a non-compliant portion of the plurality of combination center points that are not within the desired color region.

5. The method of claim 1, wherein N comprises two and estimating the combined chromaticity and luminosity corresponding to each of the plurality of combination center points comprises estimating the combined chromaticity and luminosity for two-emitter group region combinations.

6. The method of claim 1, further comprising:

identifying a portion of the plurality of bins that include center point chromaticities that are substantially different from a target chromaticity point in the desired color region; and ranking the identified portion of the plurality of bins at a high matching priority relative to other of the plurality of bins.

7. The method of claim 1, further comprising prioritizing each of the plurality of combination center points as a function of corresponding ones of the plurality of bins.

8. The method of claim 7, wherein prioritizing comprises ranking the plurality of combination center points corresponding to a difference between a bin center point included in the combination center point and a target chromaticity point.

9. The method of claim 1, further comprising prioritizing each of the plurality of combination center points corresponding to a difference between ones of the plurality of combination center points and a target chromaticity point.

10. The method of claim 9, further comprising estimating the target chromaticity point as an inventory chromaticity center point that is based on an emitter inventory that includes the plurality of light emitters.

11. The method of claim 10, wherein estimating the target chromaticity point comprises estimating the inventory chromaticity center point corresponding to an aggregate chromaticity and luminosity of light emitters in the emitter inventory.

12. The method of claim 9, wherein prioritizing the plurality of combination center points further comprises ranking ones of the plurality of combination center points corresponding to a distance to the target chromaticity point in the multiple axis color space.

13. The method of claim 9, wherein prioritizing the plurality of combination center points further comprises ranking ones of the plurality of combination center points corresponding to a plurality of concentric regions centered at the target chromaticity point, the regions including an aspect ratio substantially similar to an aspect ratio of ones of the plurality of emitter group regions.

14. The method of claim 9, wherein prioritizing the plurality of combination center points further comprises ranking ones of the plurality of combination center points corresponding to a plurality of concentric regions centered at the target chromaticity point, the regions including an aspect ratio substantially similar to an aspect ratio of a bounded area corresponding to distribution data of emitter inventory bin data.

15. The method of claim 1, further comprising prioritizing the plurality of bins corresponding to a difficulty in combining emitters in each of the plurality of bins relative to other ones of the plurality of bins.

16. The method of claim 15, wherein the difficulty in combining emitters in each of the plurality of bins corresponds to distribution data of the plurality of light emitters relative to the plurality of bins.

17. The method of claim 1, wherein the multiple axis color space comprises International Commission on Illumination (CIE) 1931 that expresses a chromaticity as an ordered pair x, y and luminosity as Y, wherein a first emitter group region center point is represented by x1, y1, and Y1 and a second emitter group region center point is represented by x2, y2, and Y2, wherein a combination center point is expressed as x, y, and Y, wherein x and y are each functions of x1, y1, Y1, x2, y2, and Y2, and wherein Y is a function of Y1 and Y2.

18. A computer program product for selecting combinations of a plurality of light emitters, the computer program product comprising a computer usable storage medium having computer readable program code embodied in the medium, the computer readable program code configured to carry out the method of claim 1.

* * * * *